United States Patent [19]

Boser

[11] 3,938,454

[45] Feb. 17, 1976

[54] SEWING MACHINE CUTTING DEVICE

[76] Inventor: Ronald J. Boser, 19 Branwood Drive, Dix Hills, N.Y. 11746

[22] Filed: Nov. 8, 1973

[21] Appl. No.: 413,847

[52] U.S. Cl. ..... 112/130
[51] Int. Cl. ..... D05b 37/04
[58] Field of Search ..... 112/130, 129, 122, 252

[56] References Cited

UNITED STATES PATENTS

| | | | |
|---|---|---|---|
| 2,070,200 | 2/1937 | Ernst | 112/130 |
| 2,282,200 | 5/1942 | Neuman | 112/130 |
| 3,170,349 | 2/1965 | Weinkle | 112/130 X |
| 3,223,059 | 12/1965 | Jacobs | 112/130 X |
| 3,244,129 | 4/1966 | Steingruebner | 112/130 X |

*Primary Examiner*—H. Hampton Hunter
*Attorney, Agent, or Firm*—Bauer & Amer

[57] ABSTRACT

A sewing machine cutting device consisting of a reciprocating blade located in a safe position below the machine work surface, and a descending operative member which urges the material to be cut into cutting relation with said blade. Cutting action is thus achieved without impact (as occurs with a guillotine cutter) and, most important, in a selected width that corresponds to the width of said descending operative member.

3 Claims, 7 Drawing Figures

PRIOR
ART

SEWING MACHINE CUTTING DEVICE

The present invention relates generally to an improved sewing machine cutting attachment or device, wherein more particularly, the improvements thereof provide not only safe cutting or severing service, but also produce a severing cut in any selected width.

As generally understood, after the stitched attachment of a tape or the like to a product, such as a brassiere, it is necessary to sever the tape along the brassiere lower edge to thereby release the tape from its supply length. Said lower edge, however, may have portions on opposite sides of the tape which extend beyond the line where the severing cut should be provided and which therefore make it difficult to achieve a proper cutting position for a scissors-type cutter relative to the tape, unless the tape is cut with excessive length. Any such excessive length in the tape requires subsequent trimming, and thus increases costs.

The prior art practice of using a guillotine-type cutter is also not without shortcomings since the impact of the descending cutter against a flat support surface produces shock and vibration which ultimately results in malfunctioning of the sewing machine, particularly if this impact cutter is located directly behind the presser foot, and thus in close proximity to the operable parts of the sewing machine.

Broadly, it is an object of the present invention to provide an improved sewing machine cutting device overcoming the foregoing and other shortcomings of the prior art. Specifically, it is an object to achieve cutting or severing service by easing the material, from above, into cutting relation with the cutting implement, all as described in detail subsequently herein.

A cutting device for a sewing machine demonstrating objects and advantages of the present invention includes a work-engaging member advantageously mounted for descending movement on the sewing machine over the feed path of the work. Beneath, and oriented transversely of, the feed path is a reciprocating blade. In practice, the work is engaged by said descending member and moved into cutting contact with said reciprocating blade, it being further found that the width of the severing cut that is produced corresponds to the width of said member that engages and holds said work, thereby enabling a sized cut to be produced according to the width size selected for said member.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
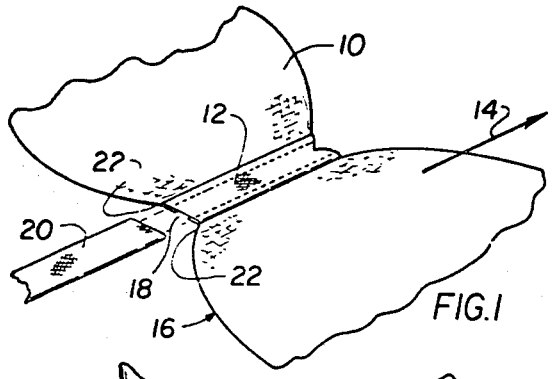
FIG. 1 illustrates the cutting or severing performance of the cutting device hereof.
Figure 2:
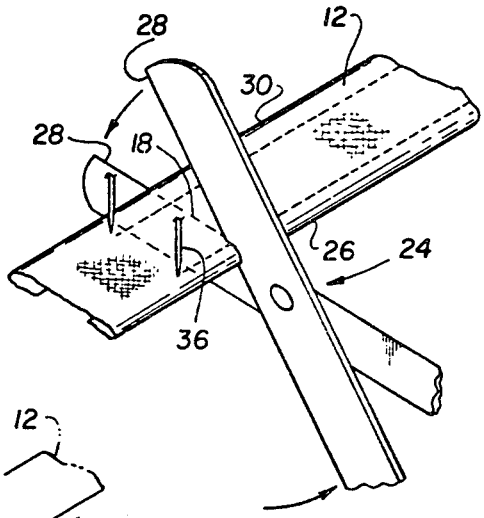
FIG. 2 illustrates the more restrictive cutting service or performance of a scissors-type cutting device exemplary of the prior art.

Reference is now made to the drawing, and initially to FIGS. 1 and 2 which illustrate cutting service and performance typically required of sewing machine cutting attachments and devices. Specifically, there is shown in FIG. 1 the front portion of a brassiere 10 having a centrally located tape 12 appropriately stitched thereto. Thus, after feed movement 14 of the work 10 beneath the sewing machine needles which results in the stitched attachment of the tape 12 thereto, it becomes necessary to sever the tape 12 at a point along the brassiere lower edge 16. In accordance with the present invention, this severing cut is readily produced substantially coextensive with the edge 16, as at the location 18, thereby releasing the attached length portion of the tape 12 from its supply length 20. In subsequent operations, the raw edge 18 and bottom edge 16 will, of course, be appropriately finished with a covering tape or the like, to enhance its appearance. One of the significant aspects of the severing cut 18 is that it is produced in the tape 12 only for the width thereof, i.e., without notching or otherwise cutting into the adjacent portions 22 of the bottom edge 16. The manner in which this is achieved will be explained in detail subsequently.

In contrast to producing a severing cut at any selected width, as exemplified by the severed tape edge 18, use of the prior art alternative illustrated in FIG. 2 presents many difficulties. Specifically, to produce cut 18 in tape 12 using a pressure air or mechanically operated scissors-type implement 24, there are two serious and obvious shortcomings. First, it is obvious that it is difficult to position the scissors 24 in cutting relation to the tape edge 26 to start the severing cut 18. Second, the cutting edges 28 of the scissors 24 which extend beyond the tape 12 will obviously nick or cut the portion of the work, to which the tape 12 is attached, which is adjacent to the remote tape edge 30. If instead of using a scissors 24, use is made of a guillotine type of cutter (not shown), the impact of this cutter against the sewing machine work surface or table ultimately results in malfunctioning of the sewing machine. This is particularly so if the location of the impact cutter is in close proximity behind the presser foot, sewing machine needles, feed dogs, and other operable parts of the sewing machine.

The improved sewing machine cutting device according to the present invention is illustrated in FIGS. 3–7, being generally designated 32 therein. The location of the cutting device 32 is in close proximity to the operable parts of the sewing machine, generally designated 34. That is, in the feed direction 14, it is immediately behind the sewing machine needles 36 and presser foot 38. In fact, said cutting device 32 includes, as one of its operative elements, a work-holding member 40 appropriately mounted for descending movement on a rod 42 depending from the sewing machine main housing 34. As is clearly illustrated, the shape of member 40 is such that the free or unattached end thereof presents a pair of spaced-apart depending bifurcated extensions 44 and 46 in facing relation to a cutting compartment, now to be described, which is strategically located just below the surface of the sewing machine table.

Figure 3:
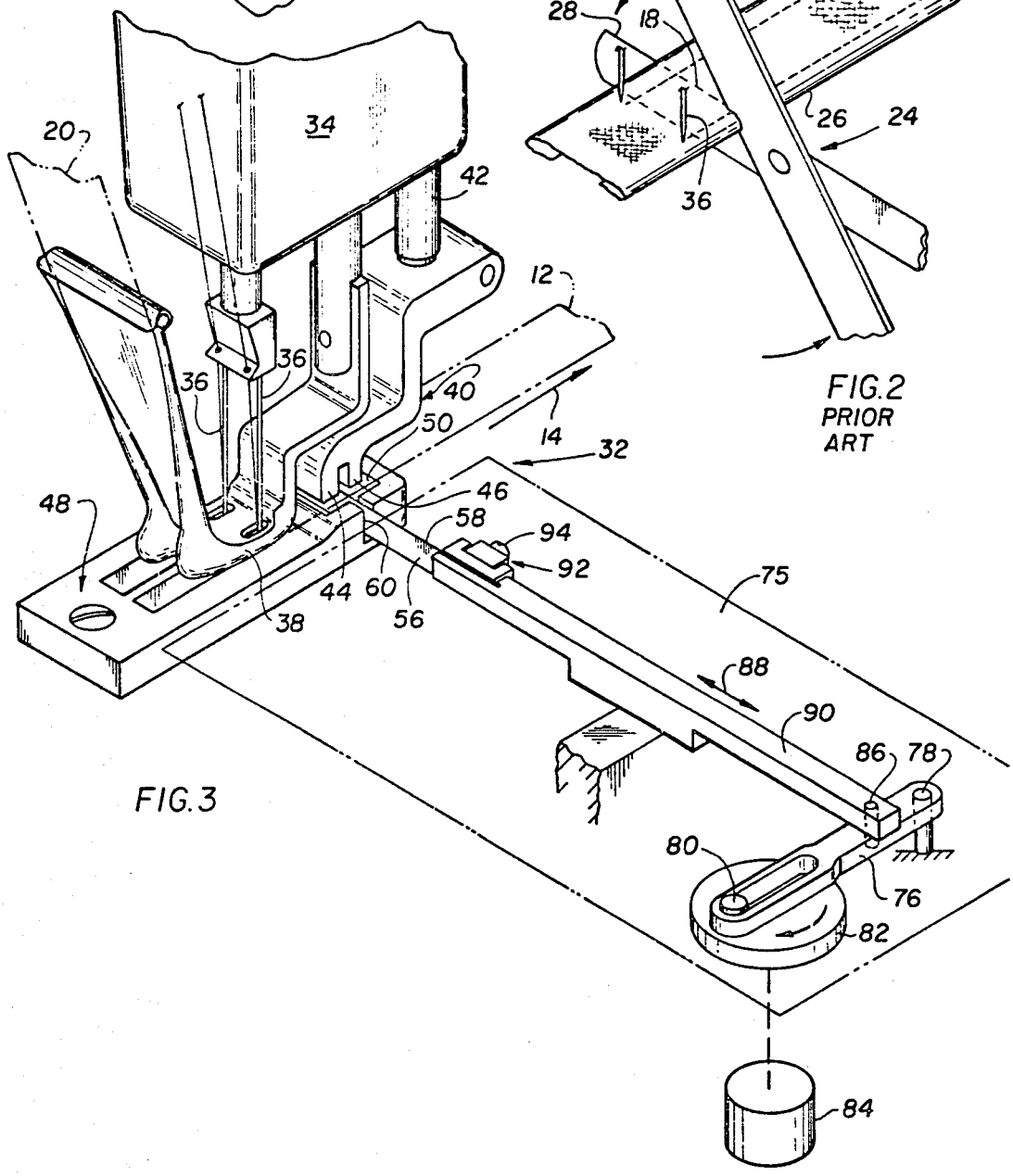
FIG. 3 is a diagramatic view illustrating the cooperative arrangement of a cutting device according to the present invention and a sewing machine.

As may best be appreciated from FIGS. 4–7 in conjunction with FIG. 3, there is advantageously formed at the rear of the sewing machine throat plate 48, the cutting compartment 50 bounded by facing walls 52 and 54. The previously noted extensions 44, 46 align with the compartment 50 and are arranged, in fact, to descend into the compartment 50 preparatory to producing the severing cut 18 in the tape 12.

Figure 5:
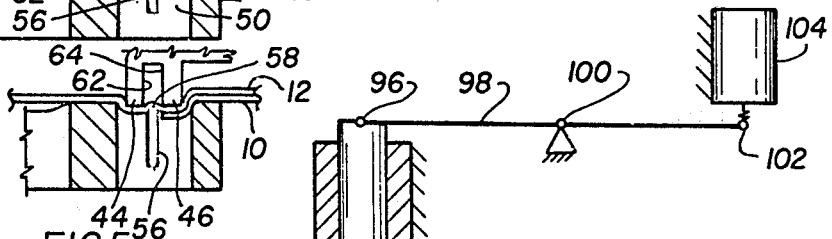
Figure 6:
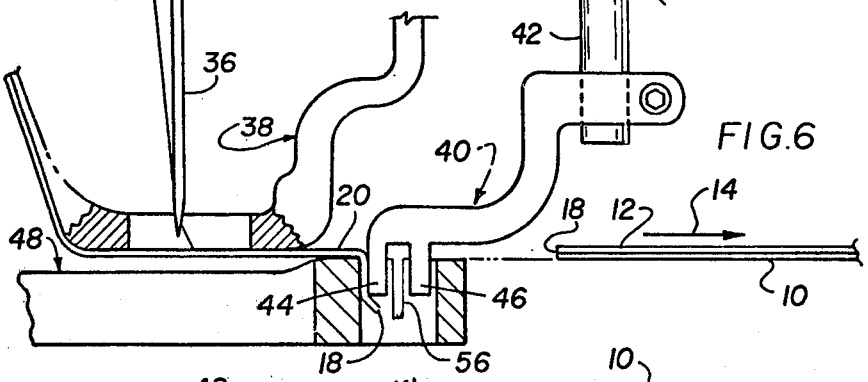

Disposed for reciprocating movement centrally of the compartment 50 is a blade 56 having an upper cutting edge 58 thereon. Blade 56 extends through notches 60 in opposite sides of the compartment 50. In the operative central location of the blade 56, as clearly illustrated in FIGS. 4–7, the blade aligns with the clearance space 62 between the extensions 44 and 46. As a consequence, in response to the descending movement of the member 40, tape 12 and also work 10 to which it is stitched, are forced downwardly into the compartment 50. The materials 12, 10, as illustrated in FIG. 5, are stretched in spanning relation across the clearance space 62, while the adjacent portions are actually urged below the level of the blade edge 58 by the descent of the extensions 44 and 46. In this manner, the materials 12, 10 are held in cutting relation with the reciprocating blade 56 until, as illustrated in FIG. 6, the severing cut 18 is produced releasing the tape 12 from its supply length 20.

Figure 7:
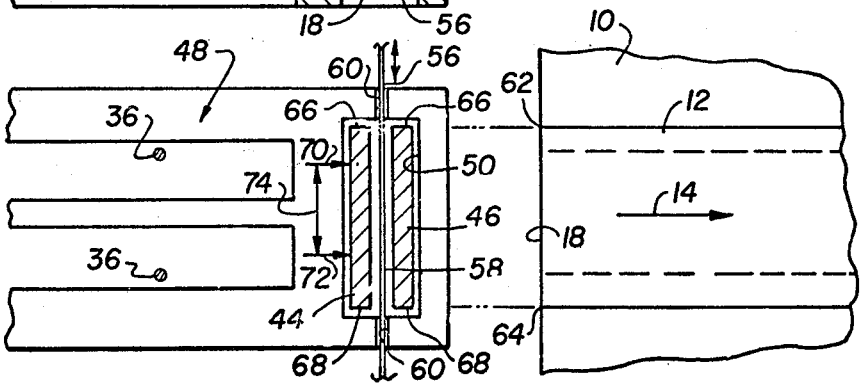
FIG. 7 is a plan view projected from FIG. 6, illustrating further structural details of the cutting device hereof.

Not only is the foregoing severing cut 18 achieved without any impact, but as may best be appreciated from FIG. 7, the width of the severing cut produced in the tape 12 along the edge 18, as measured between the two reference points 62 and 64, are substantially the same width as that of the extensions 44, 46, as measured between the opposite sides 66 and 68 thereof. Thus, in the illustrated embodiment, the severing cut 18 is produced for practically the entire width of the cutting compartment 50. However, if it is required, a severing cut, such as 18, can also be produced in any other selected width. For example, to produce such a severing cut in a smaller dimension such as, for example, half the width of the cutting compartment 50, use need only be made of correspondingly sized extensions 44, 46, each having side edges terminating, not at the locations 66 and 68, but rather at the locations 70, 72 (illustrated, for simplicity sake, only in connection with extension 44). Such a sized extension would produce a severing cut in a reduced width 74, since only this width of the tape 12 is moved into and held in cutting relation with the cutting edge 58 of the reciprocating blade 56. The portions of the material not actually pushed into cutting relation with the blade 56 by the extensions 44 and 46 have been found in practice to remain intact, and are thus substantially unaffected by the cutting action of the blade 56.

Although any appropriate means may be utilized to reciprocate the blade 56 to produce the cutting action just described, for completeness sake one such mechanism, located beneath the work surface 75, will now be generally described. The same may include a remotely located crank 76 pivotally mounted at one end, as at 78, and at its other end engaging a pin 80 of a driving member 82 which is powered in rotation by a motor 84. Crank 76 is connected, as at 86, so as to impart reciprocating movement 88 to a connecting rod 90 which, at its opposite end, is detachably connected, as by means 92, to the blade 56. Attachment means 92 may be any one of a number of appropriate constructions which readily permits firm gripping of the blade 56, and also readily enables the release thereof preparatory to maintenance change of the blade when the edge 56 becomes dull. To this end, means 92 includes the threaded member 94 for tightening and loosening the grip that is exerted on the blade 56.

Figure 4:
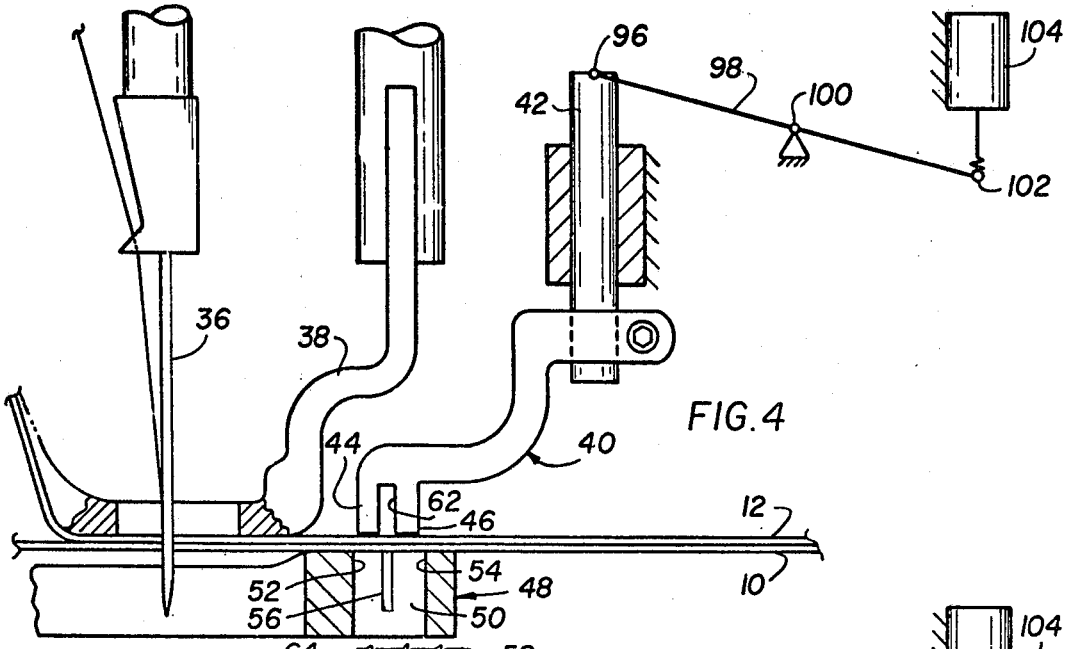
FIGS. 4, 5 and 6 are side elevational views, partly in section, illustrating a typical sequence of movement in the component parts of the cutting device hereof.

Not only may any appropriate means be utilized to urge blade 56 through its reciprocating movement, but any appropriate means may also be used to urge the member 40 from a clearance position, as illustrated, for example, in FIG. 4, through descending movement as described, which results in the forcing of the material to be cut into cutting contact with the reciprocating blade 56. Also, for completeness sake, it is diagramatically illustrated that the rod 42 is operatively connected, as at 96, to a connecting rod 98 which is centrally pivotally mounted at 100, and at its opposite end 102 has an operative connection to a pressure air operated cylinder 104. Whatever mechanism is utilized to urge the member 40 through its descending movement, it should be readily appreciated that such mechanism is easily capable of providing said descending movement, and of thus producing a severing cut, without any attendant impact. In other words, there is no shock or vibration produced by the contact of a descending cutting edge against a flat support surface, as is characteristic of a guillotine cutter. Also, the clearance position of member 40, and more particularly of the extensions 44, 46 thereof, as illustrated in FIG. 4, is in close proximity to the entrance opening of the cutting compartment 50, and this greatly minimizes any possibility of the operator or any other person in the vicinity of the sewing machine from making inadvertent contact with the reciprocating blade 56. The extensions 44, 46 to this extent therefore function as a closure for the cutting compartment 50 and thereby minimize any safety hazards associated with the reciprocating cutting blade 56.

For the foregoing and other reasons herein described, cutting device 32 represents a safe sewing machine attachment for producing a severing cut in work being sewn by the sewing machine to any selected width. A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. The combination with a sewing machine having a work surface and means defining a feed path along said work surface for work being sewn by said sewing machine of a cutter for severing said work at the termination of the sewing interval, said cutter comprising wall means bounding a cutting compartment below said work surface and along said feed path, crank means located adjacent said feed path and extending into said cutting compartment, a blade operatively connected to be continuously reciprocated by said crank means disposed in said cutting compartment, a work-positioning member mounted on said sewing machine for selective descending movement into said cutting compartment for moving said work therewith into said cutting compartment, and depending bifurcated extensions on said work-positioning member adapted to urge and hold said work in spanning relation therebetween in cutting contact with said continuously reciprocating blade, whereby a severing cut is produced in said work for the length thereof in said spanning relation between said depending extensions.

2. The combination as defined in claim 1 wherein said work-positioning member normally has an elevated position relative to said cutting compartment which minimizes the exposure of said reciprocating blade so as to correspondingly minimize the safety hazard thereof.

3. The combination as defined in claim 2 including a selectively detachable connection between one end of said blade and said crank means which is effective to permit maintenance changing of said blade incident to the detachment thereof from said crank means.

* * * * *